United States Patent [19]

Becker et al.

[11] Patent Number: 4,996,510

[45] Date of Patent: Feb. 26, 1991

[54] METAL OXIDE VARISTORS AND METHODS THEREFOR

[75] Inventors: Paul Becker, San Francisco; Carol Powers, Redwood City; Mark S. Thompson, San Carlos, all of Calif.

[73] Assignee: Raychem Corporation, Menlo Park, Calif.

[21] Appl. No.: 447,748

[22] Filed: Dec. 8, 1989

[51] Int. Cl.[5] ..... H01C 7/10

[52] U.S. Cl. ..... 338/21; 338/20; 264/61; 29/610.1

[58] Field of Search ..... 338/20, 21; 264/56, 264/60, 61; 29/610.1; 361/117, 126, 127

[56] References Cited

U.S. PATENT DOCUMENTS

| | | |
|---|---|---|
| 4,023,961 | 5/1977 | Douglas et al. . |
| 4,094,061 | 6/1978 | Gupta et al. . |
| 4,103,274 | 7/1978 | Burgess et al. . |
| 4,142,996 | 3/1979 | Wong et al. . |
| 4,198,443 | 4/1980 | Pitha . |
| 4,285,839 | 8/1981 | Wong . |
| 4,416,963 | 11/1983 | Takimoto et al. . |
| 4,436,650 | 3/1984 | Bowen . |
| 4,452,729 | 6/1984 | Carlson et al. . |
| 4,510,112 | 4/1985 | Lauf . |
| 4,535,314 | 8/1985 | Kanai et al. . |
| 4,540,971 | 9/1985 | Kanai et al. . |
| 4,551,268 | 11/1985 | Eda et al. . |
| 4,575,440 | 3/1986 | Pallila . |
| 4,681,717 | 7/1987 | Brooks et al. . |
| 4,724,416 | 2/1988 | Nakata et al. . |
| 4,767,729 | 8/1988 | Osman et al. . |

FOREIGN PATENT DOCUMENTS

| | | |
|---|---|---|
| 2526137 | 12/1976 | Fed. Rep. of Germany . |
| 1518184 | 7/1978 | United Kingdom . |

OTHER PUBLICATIONS

1985, Dosch et al., "Chemical Preparation of High Field Zinc Oxide Varistors", Sandia National Laboratories Report, SAND85-0195, Technical Info. Service, U.S. Dept. of Commerce.

Lauf et al., Am. Ceram. Soc. Bull. 68(2), 278-281 (1981).

Tran et al., "Manufacture of Varistors Through Impregnation of a Commercial Zinc Oxide", (Mar. 1986), (with translation).

*Primary Examiner*—Mark J. Reinhart
*Assistant Examiner*—Marvin M. Lateef
*Attorney, Agent, or Firm*—Yuan Chao; Herbert G. Burkard

[57] ABSTRACT

A varistor comprises a primary varistor metal oxide, aluminum in an amount of about 1 to about 30 parts per million (ppm), about 0.1 to about 0.5 mole % bismuth, about 0.1 to about 1.5 mole % antimony, about 0.1 to about 1 mole % chromium, about 0.1 to about 1.0 mole % manganese, about 0.1 to about 2.0 mole % cobalt, and about 0 to about 1.0 mole % boron. Each of these elements is present in the form of its oxide and the varistor has a DC leakage current at 80% of $V_{1ma/cm2}$ of less than $1.0\times10^{-7}$ amp/cm$^2$.

15 Claims, No Drawings

METAL OXIDE VARISTORS AND METHODS THEREFOR

BACKGROUND OF THE INVENTION

This invention relates to a metal oxide varistor having unique electrical characteristics and methods for making the same.

Metal oxide varistors possess several electrical characteristics which make them useful as, for example, surge arrestors for protecting electrical equipment from transients on AC power lines created by lightning strikes or switching electrical apparatus. Sakshaug et al., in a paper entitled "Metal Oxide Arresters on Distribution Systems—Fundamental Considerations," presented at the IEEE/PES meeting of winter 1989, discusses the use of metal oxide varistors as surge arresters. Varistors can also be used for driving liquid crystal displays.

A metal oxide varistor, in general, exhibits a nonlinear current-voltage relationship which may be represented by the equation $I=(V/C)^{\alpha}$, where V is the voltage between two points separated by the varistor material, I is the current flowing between the points, C is a constant, and $\alpha$ (or alpha) is a measure of the varistor nonlinearity. $\alpha$ can be calculated by the following equation:

$$\alpha=\log(I_2/I_1)/\log(V_2/V_1)$$

where $V_1$ and $V_2$ are the voltages across the varistor at currents $I_1$ and $I_2$, respectively. Metal Oxide varistors generally comprise zinc oxide, together with minor amounts of other metal oxides, and typically have an alpha value of greater than 20. If the voltage applied to the varistor is less than a critical value (the varistor switching voltage) the varistor is essentially an insulator and only a small leakage current will flow through it. It is desirable that the leakage current through the varistor be as low as possible to prevent degradation of the varistor over time due to heat generated by the leakage current. If the applied voltage is greater than the switching voltage, the varistor resistance drops to low values permitting large currents to flow through it. At voltages above the switching voltage, the current through the varistor varies greatly for small changes in applied voltage so that the voltage across the varistor is effectively limited to a narrow range of values. The voltage limiting or clamping action is enhanced at higher values of alpha. It is also desirable that a varistor have high energy handling capability, that is the varistor should be capable of absorbing the maximum energy to which it is likely to be subjected. The energy absorption capability can be calculated as the product of the current, voltage and time when a square wave current is applied across the varistor for 2,000 microseconds. Other desirable electrical characteristics of a varistor are a low leakage current after the application of a high current impulse, a low AC watts loss temperature coefficient, and a small percent change in the AC watts loss after the application of a high current impulse.

Copending commonly assigned application No. 07/187,165, filed Apr. 28, 1988, of Thompson et al. discloses a varistor having among other characteristics high energy handling capabilities. Such a varistor is prepared from a precursor powder prepared as disclosed in copending commonly assigned application No. 07/193,970, filed May 13, 1988, also of Thompson et al. The disclosures of both applications are incorporated herein by reference.

SUMMARY OF THE INVENTION

We have discovered novel varistors which have low leakage currents, are highly nonlinear, clamp at desirable voltages, and retain a low leakage current after the application of a high current impulse. Further, they have a low AC watts loss temperature coefficient, and a small percent change in AC watts loss after the application of a high current impulse.

In one aspect of the invention, a varistor comprises a primary varistor metal oxide, aluminum in an amount of about 1 to about 30 parts per million (ppm), about 0.1 to about 0.5 mole % bismuth, about 0.1 to about 1.5 mole % antimony, about 0.1 to about 1 mole % chromium, about 0.1 to about 1.0 mole % manganese, about 0.1 to about 2.0 mole % cobalt, and about 0 to about 1.0 mole % boron, each of the elements being present in the form of its oxide and the varistor having a DC leakage current at 80% of $V_{1ma/cm2}$ of less than $1.0\times10^{-7}$ amp/cm$^2$.

In a preferred embodiment, the varistor comprises zinc oxide as the primary varistor metal oxide. In another preferred embodiment, the varistor has a DC leakage current after a 2400 amp/cm$^2$ current impulse of less than $5\times10^{-6}$. In yet another preferred embodiment, the varistor has an AC watts loss temperature coefficient at 80% of $V_{1ma/cm2}$ of less than 3.0. In yet another preferred embodiment, the varistor has a change in AC watts loss of less than 50% after an impulse of 2400 amp/cm$^2$.

Another aspect of the invention provides a method of making a metal oxide varistor comprising at least one primary metal oxide and one or more additive metal oxides and having a DC leakage current at 80% of $V_{1ma/cm2}$ of less than $1.0\times10^{-7}$ amp/cm$^2$, which method comprises the steps of:

(a) forming an aqueous solution comprising up to about 25 mole % (based on the additive metal oxides plus the primary metal oxides) of at least one soluble precursor of an additive metal oxide;

(b) mixing in the aqueous solution up to about 75 mole % of at least one primary metal oxide powder having an average particle size up to about 5 microns to form a suspension or slurry of the primary metal oxide powder in said solution;

(c) adding to the suspension or slurry a sufficient amount of a precipitation reagent to cause one or more of the dissolved additive metal oxide precursors to convert to an oxide or hydrous oxide and precipitate from the solution in the presence of the primary metal oxide powder in the form of an oxide or hydrous oxide;

(d) removing water and by-product salts from the suspension of primary metal oxide powder and precipitate of additive metal oxide or hydrous oxide;

(e) drying the powder and precipitate to form a metal oxide varistor precursor powder; and (f) shaping the precursor powder in a green body having a desired shape and a thickness less than or equal to 0.3 in; and (g) sintering the green body to produce a varistor having a DC leakage current at 80% of $V_{1ma/cm2}$ of less than $1.0\times10^{-7}$ amp/cm$^2$.

DESCRIPTION OF PREFERRED EMBODIMENTS

Varistors of this invention comprise a primary varistor metal oxide, aluminum in an amount of about 1 to about 30 parts per million (ppm), about 0.1 to about 0.5 mole % bismuth, about 0.1 to about 1.5 mole % antimony, about 0.1 to about 1 mole % chromium, about 0.1 to about 1.0 mole % manganese, about 0.1 to about 2.0 mole % cobalt, and about 0 to about 1.0 mole % boron, each of these elements being present in the form of its oxide. Preferred compositional ranges are: about 10 to about 20 ppm aluminum, about 0.1 to about 0.5 mole % bismuth, about 0.3 to about 0.75 mole % antimony, about 0.1 to about 0.5 mole % chromium, about 0.1 to about 0.5 manganese, about 0.5 to about 1.5 mole % cobalt, and about 0 to about 0.1 mole % boron. The varistors may further comprise between about 0 to about 1 mole % silicon and about 0 to about 2 mole % nickel.

The current-voltage response of varistors can be measured in three stages. For low current measurements, a computer-controlled operational amplifier is used to step up DC voltage to the sample until the current through the sample as measured on an ammeter reaches 1 mA. The voltage at which a current density of 1 mA/cm$^2$ passes through the varistor is referred to as the "switch voltage" ($V_{1ma/cm2}$). For the second stage, a single 60 Hz AC triangular wave is applied. The current through the varistor generates a voltage across a 10 ohm shunt resistor and the resulting current-voltage waveforms are captured on an oscilloscope. Finally, capacitive discharge pulses of increasing voltage are applied and the current is monitored using a 0.1 ohm shunt resistor and captured on the oscilloscope at a sampling rate of 10 MHz. Voltage and current readings are taken at their peak values. Typically, a total of 100 current-voltage points are taken for each sample. The DC leakage current is defined as the current passing through the varistor at a voltage whose value is 80% of the varistor's "switch voltage." The 2400 amp/cm$^2$ current impulse ($8\times20$ $\mu$S) is generated by a capacitive discharge from a Haefeley Impulse Tester, Model PC6-288. The DC leakage after the 2400 amp/cm$^2$ impulse is measured in reverse polarity to the impulse. The AC watts loss temperature coefficient is the ratio of watts dissipated by the varistor at 115° C. to the watts dissipated at 25° C., both watts loss values being determined at a peak AC voltage of 0.8 times the varistor's switch voltage. The change in AC watts loss is equal to $(W_2-W_1)/W_1\times100\%$, where $W_1$ is the AC watts loss as sintered and $W_2$ is the AC watts loss after a 2400 A/cm$^2$ impulse, both AC watts loss values being measured at 25° C. and 0.8 times the varistor's switch voltage.

Preferred varistors of this invention have a DC leakage current at 80% of $V_{1ma/cm2}$ of less than $1.0\times10^{-7}$ amp/cm$^2$, more preferably less than $5\times10^{-8}$ amp/cm$^2$. The DC leakage current after a current impulse of 2400 amp/cm$^2$ is preferably less than $5\times10^{-6}$ amp/cm$^2$. The AC watts loss temperature coefficient at 80% of $V_{1ma/cm2}$ is preferably less than 3.0, more preferably less than 2.5. The percent change in AC watts loss after an impulse of 2400 amp/cm$^2$ is preferably less than 50%, more preferably less than 10%. Varistors of this invention exhibit an alpha value of at least about 50 over about 4 orders of magnitude of current between $1\times10^{-7}$ and $1\times10^{-3}$ amp/cm$^2$. Preferably alpha is at least 65 over 4 orders of magnitude of current between $1\times10^{-7}$ and about $1\times10^{-3}$ amp/cm$^2$.

The varistors of this invention are made by:

(a) forming an aqueous solution comprising up to about 25 mole % (based on the additive metal oxides plus the primary metal oxides) of at least one soluble precursor of an additive metal oxide;

(b) mixing in the aqueous solution up to about 75 mole % of at least one primary metal oxide powder having an average particle size up to about 5 microns to form a suspension or slurry of the primary metal oxide powder in the solution;

(c) adding to the suspension or slurry a sufficient amount of a precipitation reagent to cause one or more of the dissolved additive metal oxide precursors to convert to an oxide or hydrous oxide and precipitate from the solution in the presence of the primary metal oxide powder in the form of an oxide or hydrous oxide;

(d) removing water and by-product salts from the suspension of primary metal oxide powder and precipitate of additive metal oxide or hydrous oxide;

(e) drying the powder and precipitate to form a metal oxide varistor precursor powder;

(f) shaping the precursor powder in a green body having a desired shape and a thickness less than or equal to 0.3 inch; and (g) sintering the green body to produce a varistor having less than or equal to 0.5 mole % bismuth and a DC leakage current at 80% of $V_{1ma/cm2}$ of less than $1.0\times10^{-7}$ amp/cm$^2$.

This process provides a controllable means of preparing metal oxide varistor precursor powder having the desired average particle size of the zinc oxide, having the desired average particle size of the additive metal oxides and having the desired distribution of the additive metal oxide particles throughout the zinc oxide particles. In its basic aspect this process involves dissolving soluble forms of the additive metals in aqueous solution, adding to the solution zinc oxide powder to form a suspension or slurry and precipitating the additive metals in the form of oxides or hydrous oxides directly onto or among the particles of insoluble zinc oxide powder present in the suspension or slurry. Most of the water is then removed and the by-product salts washed from the resulting powder and most of the wash water is removed to leave a wet powder. Although the resulting powder can be dried to dryness and mechanically ground to a desired particle size, the full advantage of this invention is realized when the resulting powder is kept wet and is then spray dried or freeze dried. The above wet powder mass remaining when water is removed can be in the form of a slurry or can be in the form of a wet cake, provided that it remains dispersible for drying. This wet powder mass is then dispersed in a liquid medium, usually aqueous, with conventional additives and processing aids, such as polyvinyl alcohol, polyethylene glycol, Darvan "C" deflocculant, and the like, to make the dispersion suitable for spray drying. The resulting spray dried powder is free flowing and exhibits the desired properties outlined above and particularly the property of the additive metal oxide particles being smaller and evenly distributed among the larger zinc oxide particles.

Good control of the metal oxide varistor precursor powder preparation can be exercised through the variables of the process of this invention. The zinc oxide powder can be prepared by any of the conventional mechanical, chemical or precipitation methods to provide the desired average particle size and other desired properties or characteristics. Once the desired zinc oxide powder is selected for use in this process, the average particle size of the powder does not change significantly through this process, because of the absence of mechanical processing, although the usual agglomeration of particles may occur in the spray drying or other drying processes. However, such agglomeration does not affect the relative particle sizes of the additive metal oxides and the zinc oxide particles or the distribution of the smaller additive metal oxide particles throughout the larger zinc oxide particles.

The average particle sizes of the additive metal oxides can be controlled during the precipitation of the additive metal oxides or hydrous oxides onto or among the zinc oxide particles through the selection and concentration of the soluble precursor of the additive metal oxide in the starting solution, the reaction rate, the selection and rate of addition of the precipitation reagent, the precipitation rate, temperature, pH, mixing and other conditions employed during the conversion of the soluble additive metal oxide precursor to the additive metal oxide or hydrous oxide and during the precipitation of the additive metal oxide or hydrous oxide onto or among the zinc oxide particles. The amount of insoluble zinc oxide powder present in the solution as a suspension or slurry, i.e., the percent solids of zinc oxide, during the reaction and precipitation will also affect the average particle size and distribution of the additive metal oxide particles on or among the zinc oxide particles. It will be recognized that a small amount of the zinc oxide will dissolve in the solution and the remainder of the zinc oxide will be insoluble and form the desired suspension or slurry in the solution. The amount of zinc oxide that dissolves in the solution is not significant, except from the standpoint that it affects the pH of the solution.

The desired uniform distribution of the additive metal oxide particles throughout the zinc oxide powder will inherently result from the process of this invention, provided that the solution is adequately mixed and the dispersion, suspension or slurry of zinc oxide powder in the solution is maintained substantially uniform during at least the precipitation and preferably the conversion and precipitation of the additive metal oxides or hydrous oxides. It may be desirable in most instances to use a dispersant, such as Darvan C, to assure that the zinc oxide powder remains adequately mixed and dispersed during the conversion and precipitation of the additive metal oxides and hydrous oxides. When removing the water and the by-product salts resulting from the precipitation, it is desirable in most instances to avoid completely drying the resulting wet metal oxide varistor precursor powder mass. If the resulting wet powder mass is dried too dry, the powder may form solid agglomerates or a cake which would then need to be crushed and sieved by mechanical means. In some instances such mechanical processing may be acceptable, but in most cases such mechanical processing would not provide the desired precursor powder uniformity. When the salts and various by-products of the reaction and precipitation are removed and the water extracted, it is desirable to merely keep the resulting wet powder mass in a form that it is readily dispersible in a liquid medium suitable for spray drying or other substantially equivalent drying processes, such as freeze drying.

The wet powder mass can normally be prepared for conventional spray drying by adding water to give about a 25–60% solids slurry and using appropriate processing aids, such as polyvinyl alcohol, polyethylene glycol, and a deflocculent. The slurry can be spray dried on conventional spray drying equipment to produce a dry free-flowing metal oxide varistor precursor powder having the desired properties outlined above. Any suitable spray drying, freeze drying or other dry powder preparation process can be used to produce the final dry free-flowing metal oxide varistor precursor powder from the wet powder mass. It is understood that in the discussion and description of this process reference to zinc oxide is intended to be reference to the primary metal oxide for the varistor and that this invention is equally applicable to any of the primary varistor metal oxides exhibiting varistor properties when appropriately doped with additive metal oxide dopants. Such primary varistor metal oxides include but are not limited to zinc oxide (ZnO), titanium oxide ($TiO_2$), strontium oxide (SrO), strontium titanate ($SrTiO_3$) and mixtures thereof.

It is understood that the reference to additive metals or additive metal oxides is intended to include any of the additive metal oxides for varistors which can be used as dopants or sintering aids for or with the primary metal oxide. These additive metal oxides include but are not limited to $Al_2O_3$, $B_2O_3$, BaO, $Bi_2O_3$, CaO, CoO, $Co_3O_4$, $Cr_2O_3$, FeO, $In_2O_3$, $K_2O$, MgO, $Mn_2O_3$, $Mn_3O_4$, $MnO_2$, NiO, PbO, $Pr_2O_3$, $Sb_2O_3$, $SiO_2$, SnO, $SnO_2$, SrO, $Ta_2O_5$, $TiO_2$ and mixtures thereof. In addition, various other additives which are known in the varistor art may be included.

The proportions of the primary metal oxide and additive metal oxides will generally be in the range of about 75 mole % to about 99 mole % primary metal oxide and in the range of about 1 to about 25 mole % additive metal oxides, and preferably about 90 to about 98 mole % primary metal oxide and about 2 to about 10 mole % additive metal oxides. A preferred additive metal oxide is bismuth oxide ($Bi_2O_3$) which is usually present in amounts ranging from about 0.1 mole % to about 4.0 mole % and is usually present along with various other metal oxides. It is particularly preferred to use along with the bismuth oxide, at least one or more of manganese oxide ($MnO_2$), chromium oxide ($Cr_2O_3$), cobalt oxide ($Co_3O_4$), boron oxide ($B_2O_3$), tin oxide (SnO or $SnO_2$), antimony oxide ($Sb_2O_3$), aluminum oxide ($Al_2O_3$), or mixtures thereof.

In this preferred process, the additive metal oxides are formed from soluble additive metal oxide precursors, which are the water soluble forms of the desired additive metal. These precursors may be nitrates, carbonates, chlorides, acetates and the like. An additive metal oxide precursor should be sufficiently soluble in the solution in the presence of the other dissolved additive metal oxide precursors and in the presence of the dispersed, suspended or slurried zinc oxide powder in order that the desired amount of additive metal oxide or hydrous oxide can be precipitated on or among the zinc oxide particles. Some examples of soluble additive metal oxide precursors are: for bismuth, $Bi(NO_3)_3.5H_2O$ dissolved in dilute nitric acid or $Bi_5O(OH)_9(NO_3)_4$; for antimony, $SbCl_3$ or $K(SbO)C_4H_4O_6.H_2O$; for cobalt, $Co(NO_3)_2.6H_2O$; for manganese, $Mn(C_2H_3O_2)_2.4H_2O$; for lead, $Pb(C_2H_3O_2)_2$; for chromium, $Cr(NO_3)_3.9H_2O$;

for aluminum, $Al(NO_3)_3.9H_2O$; and the like. The selection of the soluble additive metal oxide precursor for inclusion in the aqueous solution prior to precipitation in the desired concentration to provide the desired amount of the additive metal oxide on the zinc oxide powder will be apparent to one skilled in the art following the principles of the present invention and the specific examples and embodiments disclosed herein.

In some cases it may be desirable to dissolve one or more soluble additive metal oxide precursors in the solution, add the primary metal oxide powder to form the suspension or slurry, convert and precipitate that or those additive metal oxides or hydrous oxides, then dissolve one or more other soluble additive metal oxide precursors in the solution (slurry) and convert and precipitate that or those additional additive metal oxides or hydrous oxides. Such series introduction of additive metal oxide precursors and the conversion and precipitation of the oxides and hydrous oxides onto or among the primary metal oxide particles can be repeated as desired. It should also be noted that in some cases the addition of the zinc oxide powder or other primary metal oxide powder will cause the conversion and precipitation or at least the precipitation of one or more additive metal oxides or hydrous oxides, for example by causing a pH change. This can be an advantageous procedure to use because of the speed at which the additive metal oxide or hydrous oxides can be formed and/or precipitated and can be particularly suited to a continuous process.

The primary metal oxide powder, such as zinc oxide powder, added to the solution of soluble additive metal oxide precursors can be any desired primary metal oxide powder having the desired average particle size and other properties, such as particle size distribution, surface area; density and the like. The primary metal oxide powder should have a minimum of impurities particularly any impurities which would interfere with forming or maintaining the aqueous solution, precipitating the additive metals onto or among the primary metal oxide powder, or sintering or the grain growth during sintering of the pressed powder, or forming the grain boundaries between the grains of the primary metal oxide formed during sintering of the varistor.

The most used and generally preferred primary metal oxide powder is zinc oxide. In general it is preferred that the primary metal oxide powder have an average particle size in the range of about 0.01 to about 5 microns, more preferably about 0.1 to about 2 microns, more preferably about 0.1 to about 1 micron.

The percent solids of the primary metal oxide powder in the solution during the precipitation of the additive metal oxides or hydrous oxides in general should be between about 1 and about 50 wt %, preferably between about 5 and about 40 wt % and usually more preferably between about 10 and about 30 wt %. The concentration of primary metal oxide powder solids present in the solution should be high enough to provide an adequate density of particles and sites for the additive metal oxides or hydrous oxides to precipitate on or between and allow the precipitation to occur in a uniform, evenly distributed manner.

It is important to maintain adequate mixing or agitation of the dispersion, suspension or slurry during the precipitation of the additive metal oxides or hydrous oxides to assure a uniform distribution of the additive metal oxides or hydrous oxides throughout the primary metal oxide particles. As mentioned above, it may be desirable to use a dispersing agent to assist in maintaining an adequately uniform suspension or slurry during mixing and precipitation. The percent solids and degree of mixing can be used to control the particle size of the resultant additive metal oxide particles. If the percent solids of primary metal oxide powder is too low or the degree of mixing of the suspension or slurry in the solution is inadequate, the additive metal oxides or hydrous oxides may form larger particles than desired or may form agglomerates with themselves rather than the desired uniform distribution of small additive metal oxide or hydrous oxide particles throughout the larger primary metal oxide particles.

The "precipitation reagent" can be any appropriate material or combinations of materials which cause the soluble additive metal oxide precursors dissolved in solution to be converted to metal oxides or hydrous oxide and precipitate in the presence of, onto or among the primary metal oxide particles suspended or slurried in the aqueous solution. The selection of the appropriate precipitation reagent will depend on the particular dissolved soluble additive metal oxide precursors present in the aqueous solution, the concentrations of the additive metal oxide precursors in the solution, the pH of the solution and other factors, such as the percent solids of the primary metal oxide powder. Adjusting the pH is usually the most convenient way to control the initiation rate and the conversion and precipitation. In some instances, a combination of materials will be necessary where one precipitation reagent converts and/or precipitates one or more soluble additive metal oxide precursors and another precipitation reagent converts and/or precipitates one or more other soluble additive metal oxide precursors to the oxide or hydrous oxide. In general, the precipitation reagent can be aqueous, organic or inorganic bases, such as $NH_4OH$, $NR_4OH$, NaOH, and the like. The precipitation reagent may include a pH modifier or pH buffer or may itself adjust the pH of the solution to facilitate the appropriate conversion of the soluble additive metal oxide precursors to metal oxides or hydrous oxides and the precipitation of the metal oxide or metal oxide hydrates. It has been observed in many solutions that the zinc oxide powder itself will change and sometimes buffer the pH of the solution.

It should be noted that in some cases the precipitation reagent may not itself cause the precipitation of the additive metal oxide or hydrous oxide, but may only convert the additive metal to the oxide or hydrous oxide form, which then precipitates due to some other change, such as removal of water, change in pH, and the like. In some instances the conversion likewise may not take place until water is removed or another reagent is added.

The term "hydrous oxide" is used herein to mean the compound or material that can be converted to the oxide by removal of water. These hydrous oxides include such forms as oxide hydrates, hydroxides and the like. The hydrous oxide referred to herein may convert to the oxide form at any stage: during removal of water from the suspension or slurry, during the drying or other processing of the powder, such as during the spray drying or freeze drying, or during the pressing or sintering of the powder to form the varistor. Although calcining will not normally be necessary when practicing this preferred process, it does not preclude the uptake of oxygen during the drying, pressing, sintering or other processing of the metal oxide varistor precursor powder or the calcining of the precursor powder in a separate step, if desired.

When the precipitation reagent addition is complete and the conversion is effected, water is normally removed from the suspension or slurry by filtration, settling and decanting, centrifuging or by other conventional liquid-solids separation means. The solids are then washed to remove the by-products of the conversion reaction, such as salts. A preferred method of removing the water and washing out the impurities and reaction by-products is by filtration.

The resulting solids can be dried at this point, but if dried too dry will usually form hard cakes or agglomerates which will require subsequent grinding, sieving and similar mechanical processing to form a varistor precursor powder before pressing to form varistors. While this may be adequate for some uses, it does not produce the uniform particles generally preferred.

It is generally preferred that the solids remaining after removal of water and reaction by-products not be dried to a degree of dryness which will cause the particles to agglomerate and require mechanical processing such as grinding for subsequent use. The solids are preferably kept wet enough so that the particles can be dispersed, suspended or slurried in a liquid medium without grinding or crushing. The wet solids which can be so dispersed are referred to herein as a wet powder. The wet powder is preferably spray dried from a conventional slurry or freeze dried by conventional processes to form a dry free-flowing powder. Other methods of drying the powder may also be used.

It is not necessary in all cases to have a free-flowing powder. However, the powder should be dry enough to be pressed in mechanical presses conventionally used to form varistors and should have a low enough water content so that water volatilizing during sintering does not cause structural damage to the varistor. In general, a water content less than about 5% by weight, preferably less than 1% by weight, is desired.

The metal oxide varistor precursor powder produced by this preferred process is particularly unique because it contains uniform distribution of the relatively smaller particles of additive metal oxides throughout the relatively larger particles of primary metal oxide, such as zinc oxide.

After spray drying the primary metal oxide powder containing the additive metal oxides, the resulting metal oxide varistor precursor powder is normally a free-flowing dry powder which can be pressed into appropriate configurations using conventional presses, and conventional pressures to form varistors and other desired components having conventional or other desired sizes and configurations. The pressed articles are then sintered at appropriate temperatures for the particular metal oxide varistor precursor powder obtained from this process.

In order to obtain the desired low DC leakage properties, the varistors of this invention must be sufficiently thin to allow the necessary amount of volatile bismuth oxide to be removed during sintering. The finished device should contain between about 0.1% and about 0.5% bismuth. In general, it has been found that this requires pressed green disks whose thickness does not exceed 0.3 inch, and preferably the thickness does not exceed 0.1 inch.

The varistors of this invention have relatively low switching voltages, less than 1000 V, preferably less than 300 V.

In general it has been found that this process produces metal oxide varistor precursor powders which can be sintered at substantially lower temperatures than conventional metal oxide varistor precursor powders. For example in many cases the powder produced by the process of this invention can be sintered in the range of 900°-1000° C. but can be sintered as low as 750° C. and as high as 1500° C., depending on the composition of the powder and the grain size and other properties desired in the resulting sintered varistor. In general, it has been found that the lower sintering temperatures are particularly useful with the metal oxide varistor precursor powder made by this process because the higher temperatures produce more, and sometimes undesirable, grain growth in the final varistor product. The lower temperature also allows the use of lesser initial amounts of compounds such as bismuth oxide, which might otherwise be lost through volatilization upon sintering at an elevated temperature.

A preferred sintering temperature in the range of 900°-1100° C. will be appropriate in most cases and will produce the optimum grain size and grain boundary characteristics in the sintered varistor. An example of a preferred firing and sintering schedule follows: for 0.0750 inch thick pellets, heat from 50° C. to 125° C. over 1 hour, then at 275° C. for 3 hours, then up to 1100° C. over 3 hours, and hold at 1100° C. for 6 hours.

The sintered varistors prepared from metal oxide varistor precursor powders of this process exhibit their unique electrical properties resulting, it is believed, primarily from the uniform distribution of the smaller additive metal oxide particles throughout the primary metal oxide particles, the uniform grain growth during sintering, and the uniform grain boundary characteristics, and from using a sufficiently thin disk to allow a substantial proportion of the bismuth to be lost through volatilization during sintering.

The varistors of this invention can be electroded in conventional ways, for example by painted silver electrodes, baked-on silver ink, or other conventional electrodes used on zinc oxide varistors. Other useful electrodes include indium-gallium eutectic, aluminum, and zinc electrodes. Conventional surface preparations, coatings, passivating coatings, and other additives or materials normally used for electroding varistors can be used with the varistors of this invention. The varistors can also be potted in epoxy with leads attached thereto.

Devices made from the varistors of this invention, such as drivers for liquid crystal and other displays, circuit protection, etc., can be constructed in conventional configurations using conventional materials.

To better illustrate the present invention, the following examples are provided.

EXAMPLE 1

This example illustrates the preparation of varistor compositions of this invention.

A slurry of zinc oxide and antimony trioxide was prepared by dispersing 78.93 g ZnO (0.97 mol) and 0.729 g $Sb_2O_3$ (5.0 mmol) in 273 mL water containing 0.79 g Darvan C dispersant. With stirring, 12.84 mL ammonium hydroxide was added to the slurry. A solution of bismuth nitrate was prepared in another container by dissolving 4.90 g $Bi(NO_3)_3$ (10 mmol) in a mixture of 4.46 mL concentrated nitric acid and 8.92 mL water. This solution was then slowly diluted with an additional 287 mL water. To this diluted solution was added 2.910 g $Co(NO_3)_2$ (10 mmol), 1.000 g $Cr(NO_3)_3$ (2.5 mmol), 0.865 g of a 50% aqueous solution of $Mn(NO_3)_2$ (2.5 mmol), and 0.0038 g $Al(NO_3)_3$ (0.01 mmol). The $ZnO/Sb_2O_3$ slurry and the solution containing the nitrates were then pumped through a "T" reactor into a stirred container at 60 mL/min each, thereby causing coprecipitation of the dopant hydrous oxides to occur. The slurry was stirred for 10 minutes and then filtered through a Buchner funnel. The filter cake was redispersed in an aqueous binder (3 wt % solution) and the excess water was removed by evaporating the slurry to dryness. The dry powder was ground and classified by passing through a 60 mesh sieve. Disks measuring 0.75 inch in diameter by 0.07 inch thick were pressed at 4000 lb/in2 and fired as follows: heat from 50° C. to 125° C. in 1 hour, then to 275° C. in 3 hours, then to 1100° C. in 3 hours, and hold for 6 hours, and finally cool to 100° C. in 9 hours. After this firing schedule, the disks were annealed as follows: heat from 50° C. to 600° C. in 2 hours and hold for 4 hours, then cool to 100° C. in 5 hours. The disks were electroded and tested.

The test results for these varistors are provided in Table I below, as Samples A and B. Chemical analysis of the fired bodies showed that they contained 0.23 mol % bismuth.

EXAMPLE 2

In this comparative example, a varistor composition not according to our invention is prepared.

Varistor samples were prepared in a manner analogous to that described in Example 1, except with a powder composition (mole %) of 94.3% Zn, 3% Bi, 1% Sb, 0.5% Co, Mn, and Cr, 0.2% B, and 10 ppm Al. Chemical analysis on the fired bodies showed that they contained 1.9 mole % Bi. This composition with increased amounts of Bi resulted in varistors with higher DC leakage, lower alpha value, poor DC leakage and AC watts loss stability after high current density impulses, and a higher AC watts loss temperature coefficient. The electrical test data for this material are tabulated in Table I as Sample C.

EXAMPLE 2

This is also a comparative example utilizing prior art varistors not according to our invention.

Varistors from three commercial sources, chosen to have similar diameters and switch voltages to those of Example 1, were tested and compared against the varistors of Example 1. The results are provided in Table I. Sample D is varistor $GEV_{130}LA10A$, from General Electric Co. Sample E is varistor S14K130, from Siemens. Varistor F is S14K201U, from Panasonic.

Referring now to Table I, it can be seen that the varistors of this invention (Samples A and B) generally have a lower DC leakage current, higher alpha, a lower DC leakage current after a current impulse (Sample B), lower AC watts loss temperature coefficient, and smaller change in AC watts loss.

TABLE I

COMPARISON OF ELECTRICAL PROPERTIES OF VARISTORS

| ELECTRICAL PROPERTY | THIS INVENTION | | COMPARATIVE VARISTORS | | | |
|---|---|---|---|---|---|---|
| | A | B | C | D | E | F |
| DC leakage current at 80% of $V_{1ma/cm2}$ (amp/cm$^2$) | $2 \times 10^{-8}$ | $7 \times 10^{-8}$ | $4 \times 10^{-7}$ | $4 \times 10^{-7}$ | $1 \times 10^{-6}$ | $1 \times 10^{-6}$ |
| Alpha (coefficient of non-linearity) between $1 \times 10^{-7}$ and $1 \times 10^{-3}$ amp/cm$^2$ | 77 | 57 | 43 | 38 | 29 | 30 |
| DC leakage current after current impulse of 2400 amp/cm$^2$ (8 × 20 μsec) (amp/cm$^2$) | $4 \times 10^{-6}$ | $3 \times 10^{-7}$ | $6 \times 10^{-5}$ | $2 \times 10^{-5}$ | $1 \times 10^{-5}$ | $1 \times 10^{-5}$ |
| AC watts loss temperature coefficient (115-25° C.) at 80% of $V_{1ma/cm2}$ (peak of AC voltage wave) | 2.4 | 2.9 | 3.3 | 3.4 | 4.8 | 4.7 |
| Change in AC watts loss at 25° C. after 2400 amp/cm$^2$ impulse (%) | +47 | +9 | +185 | +132 | +86 | +56 |

We claim:

1. A varistor comprising a primary varistor metal oxide, aluminum in an amount of about 1 to about 30 parts per million (ppm), about 0.1 to about 0.5 mole % bismuth, about 0.1 to about 1.5 mole % antimony, about 0.1 to about 1 mole % chromium, about 0.1 to about 1.0 mole % manganese, about 0.1 to about 2.0 mole % cobalt, and about 0 to about 1.0 mole % boron, each of said elements being present in the form of its oxide and said varistor having a DC leakage current at 80% of $V_{1ma/cm2}$ of less than $1.0 \times 10^{-7}$ amp/cm$^2$.

2. A varistor according to claim 1, wherein the primary varistor metal oxide is selected from the group consisting of zinc oxide, titanium oxide, strontium oxide, strontium titanate, and mixtures thereof.

3. A varistor according to claim 1, wherein the primary varistor metal oxide comprises zinc oxide.

4. A varistor according to claim 1, wherein the DC leakage current after a 2400 amp/cm$^2$ current impulse is less than $5 \times 10^{-6}$ amp/cm$^2$.

5. A varistor according to claim 1, wherein the AC watts loss temperature coefficient at 80% of $V_{1ma/cm2}$ is less than 3.0.

6. A varistor according to claim 4, wherein the AC watts loss temperature coefficient is less than 2.5.

7. A varistor according to claim 1, wherein the percent change in AC watts loss is less than 50% after an impulse of 2400 amp/cm$^2$.

8. A varistor according to claim 6, wherein the percent change is less than 10%.

9. A varistor according to claim 1, having about 10 to about 20 ppm aluminum, about 0.1 to about 0.5 mole % bismuth, about 0.3 to about 0.75 mole % antimony, about 0.1 to about 0.5 mole % chromium, about 0.1 to about 0.5 mole % manganese, about 0.5 to about 1.5 mole % cobalt, and about 0 to about 0.1 mole % boron.

10. A method of making a metal oxide varistor comprising at least one primary metal oxide and one or more additive metal oxides and having a DC leakage current at 80% of $V_{1ma/cm2}$ of less than $1.0\times10^{-7}$ amp/cm$^2$, which method comprises the steps of;

(a) forming an aqueous solution comprising up to about 25 mole % (based on the additive metal oxides plus the primary metal oxides) of at least one soluble precursor of an additive metal oxide;

(b) mixing in said aqueous solution up to about 75 mole % of at least one primary metal oxide powder having an average particle size up to about 5 microns to form a suspension or slurry of the primary metal oxide powder in said solution;

(c) adding to the suspension or slurry a sufficient amount of a precipitation reagent to cause one or more of the dissolved additive metal oxide precursors to convert to an oxide or hydrous oxide and precipitate from said solution in the presence of said primary metal oxide powder in the form of an oxide or hydrous oxide;

(d) removing water and by-product salts from the suspension of primary metal oxide powder and precipitate of additive metal oxide or hydrous oxide;

(e) drying the powder and precipitate to form a metal oxide varistor precursor powder;

(f) shaping said precursor powder in a green body having a desired shape and a thickness of less than or equal to 0.3 inch; and (g) sintering said green body to produce a varistor having less than or equal to 0.5 mole % bismuth and a DC leakage current at 80% of $V_{1ma/cm2}$ of less than $1.0\times10^{-7}$ amp/cm$^2$.

11. A method according to claim 10, wherein the primary varistor metal oxide is selected from the group consisting of zinc oxide, titanium oxide, strontium oxide, strontium titanate, and mixtures thereof.

12. A method according to claim 9, wherein the primary metal oxide comprises zinc oxide.

13. A method according to claim 9, wherein the drying in step (e) is by spray drying or freeze drying.

14. A method according to claim 10, wherein the additive metal oxide is selected from the group consisting of $Al_2O_3$, $B_2O_3$, BaO, $Bi_2O_3$, CaO, CoO, $Co_3O_4$, $Cr_2O_3$, FeO, $In_2O_3$, $K_2O$, MgO, $Mh_2O_3$, $Mn_3O_4$, $MnO_2$, NiO, PbO, $Pr_2O_3$, $Sb_2O_3$, $SiO_2$, SnO, $SnO_2$, SrO, $Ta_2O_5$, $TiO_2$ and mixtures thereof.

15. A method according to claim 9, wherein the additive metal oxide is selected from the group consisting of bismuth oxide, antimony oxide, chromium oxide, manganese oxide, cobalt oxide, boron oxide, aluminum oxide, tin oxide, and mixtures thereof.

* * * * *